United States Patent [19]

Mullins, Jr.

[11] 4,252,002

[45] Feb. 24, 1981

[54] SANITARY ICE MAKER AND DISPENSER

[76] Inventor: James N. Mullins, Jr., 3501 Biway St., Fort Worth, Tex. 76114

[21] Appl. No.: 71,094

[22] Filed: Aug. 31, 1979

[51] Int. Cl.[3] ..... F25C 5/18

[52] U.S. Cl. ..... 62/344; 222/236; 285/402

[58] Field of Search ..... 62/344; 222/226, 236, 222/410; 285/399, 402

[56] References Cited

U.S. PATENT DOCUMENTS

| | | | |
|---|---|---|---|
| 2,490,718 | 12/1949 | Stellin | 285/402 X |
| 2,535,186 | 12/1950 | Anderson | 285/399 X |
| 2,858,117 | 10/1958 | Girton | 222/410 X |
| 3,151,668 | 10/1964 | Zimmermann | 62/344 X |
| 3,319,436 | 5/1967 | Wilch | 222/236 X |
| 3,473,702 | 10/1969 | Molitor | 222/226 X |
| 3,719,307 | 3/1973 | Larson | 222/236 |
| 3,902,331 | 9/1975 | True, Jr. et al. | 62/344 X |
| 3,918,266 | 11/1975 | Gindy et al. | 62/344 X |
| 4,123,918 | 11/1978 | Kohl et al. | 222/410 X |

*Primary Examiner*—William E. Tapolcai, Jr.

*Attorney, Agent, or Firm*—Wofford, Fails & Zobal

[57] ABSTRACT

What is disclosed is an ice maker and dispenser for an area that is subject to microbiological contamination, such as a hospital, and including an ice manufacturing and an ice dumping unit having the improvement comprising a circular ice container and stirrer with an aperture through which ice shapes can be dropped, a cylindrical chute disclosed below the aperture for conveying the ice shapes outwardly through a door, a cantilever corkscrew impeller for moving the ice shapes along the chute and motors and drives for effecting rotation of the stirrer in the ice container and the impeller for moving the ice exteriorly of the door. The ice chute is cylindrical, smooth and easily cleaned and sterilized when the corkscrew impeller is removed. The corkscrew impeller is easily removed by way of a quick disconnect to facilitate its being cleaned and sterilized. A short cylindrical chute is provided upwardly into the ice container so as to be easily cleaned and sterilized. A slip over spout is provided for the exterior end of the chute and extending through the door and is easily cleaned and sterilized.

1 Claim, 4 Drawing Figures

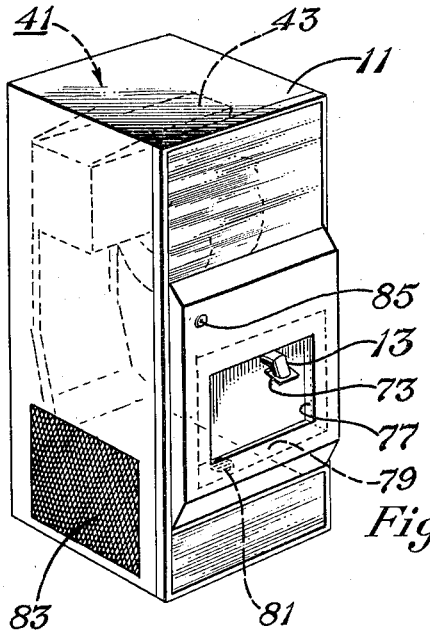
Fig.1
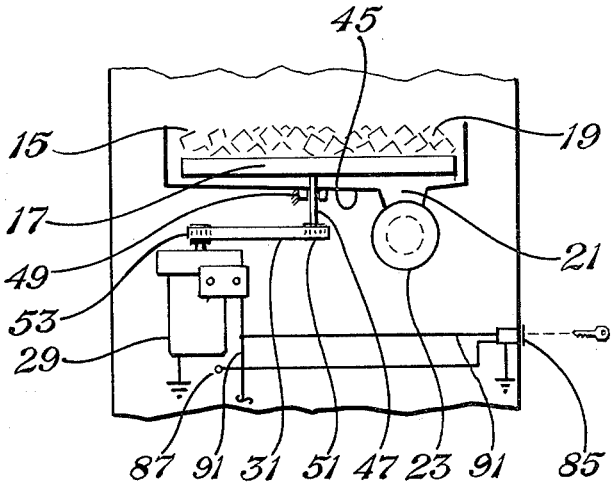
Fig.2
Fig.3
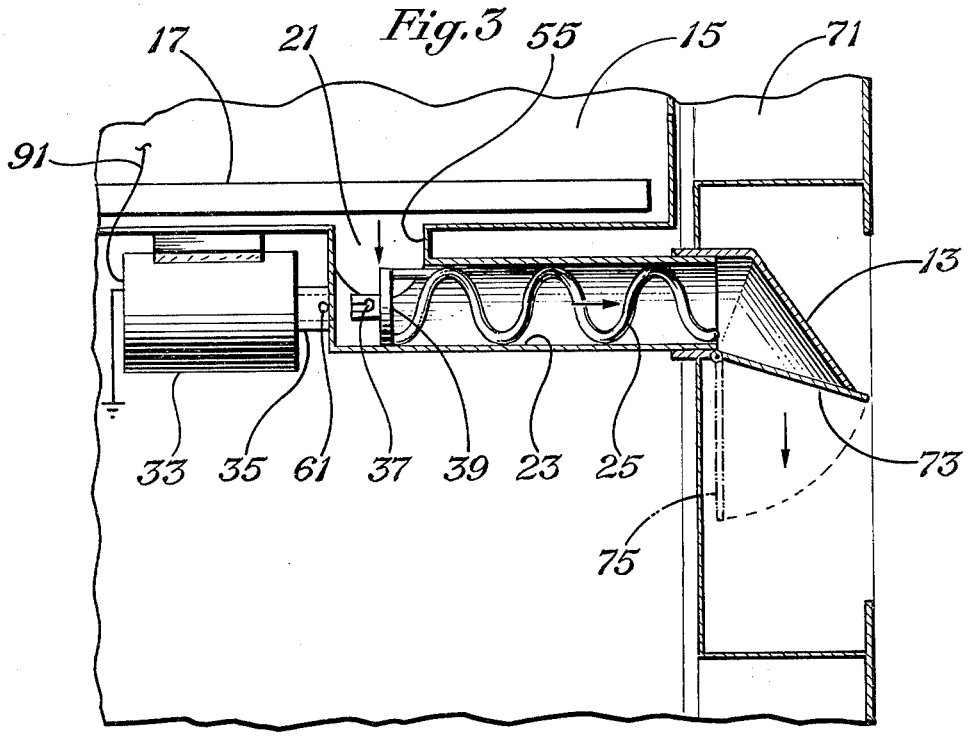
Fig.4
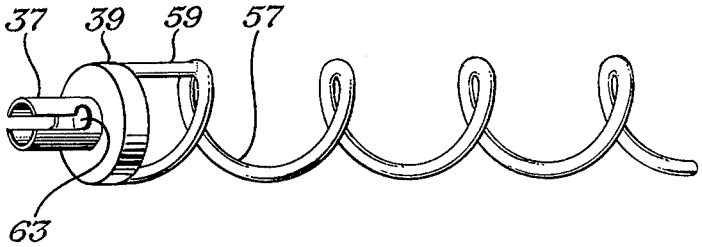

SANITARY ICE MAKER AND DISPENSER

FIELD OF THE INVENTION

This invention relates to portable ice makers and dispensers. More particularly, this invention relates to an ice maker and dispenser to be employed in an area subject to microbiological contamination; for example, in a hospital or the like.

DESCRIPTION OF THE PRIOR ART

The prior art is replete with a wide variety of ice making apparatus. The prior art has seen a wide variety of even the portable type ice makers and dispensers employed. As noted in my previously issued U.S. Pat. Nos. 3,789,570 and 4,132,049, entitled, respectively, "Bagging Apparatus and Method" and "Method and Apparatus for Bagging Material", the desciptive matter of which are incorporated herein for reference for details omitted herefrom, such units have included machines that would freeze and automatically bag ice cubes, or ice shapes at the point of consumption to eliminate the contamination from ice dispensing bins or the like. Several patents, ranging from U.S. Pat. No. 762,275 through U.S. Pat. No. 3,807,122, were cited against my previous patents but are not really more pertinent than my previous patents to this invention.

A patent search revealed the following additional patents. U.S. Pat. No. 3,422,994, shows an automatic ice maker having a screw conveyer. U.S. Pat. No. 3,537,618 shows the similar type ice maker but with a reversing mechanism to clear stalled dispensers that have been stopped by ice cubes being caught. U.S. Pat. No. 3,570,720 shows an auger that has ice cubes recirculated to break up the mass of ice. U.S. Pat. No. 3,902,331 shows a sloping tube and an auger for dispensing ice.

The prior art has not shown an economical ice maker and dispenser that can be readily cleaned and sterilized to insure the killing of difficultly killed microorganisms such as Staphyllococcus type microorganisms. Specifically, the prior art has not shown the ice containers that have an aperture in the bottom through which ice shapes can be readily dispensed into a smooth, cylindrical chute and then brought forwardly by way of a stainless steel spiral, or corkscrew impeller, and dispensed through a removable spout that is readily removed cleaned and sterilized.

SUMMARY OF THE INVENTION

Accordingly, it is an object of this invention to provide apparatus that can be readily cleaned and sterilized to avoid contamination in a given environment, yet manufacture and dispence ice upon demand.

Specifically, it is an object of this invention to provide apparatus that uses gravitational force for dispensing the ice shapes by way of a short, easily cleanable chute into a second horizontal chute that is also smooth and easily cleanable and provide spiral impeller means for moving the ice shapes along the chute without employing an auger, providing easy disassembly and cleaning and sterilizing features in the chute, as well as the spiral impeller and spout.

These and other objects will become apparent from the discriptive hereinafter, particularly when taken inconjunction with the appended drawings.

In accordance with this invention, there is provided an improvement in an ice maker and dispenser having an ice manufacturing unit capable of making ice shapes less than two inches in dimensions and an ice dumping means for dumping the ice that has been manufactured. The improvement comprises the easily cleaned and sterilized model for use in areas that are subject to microbiological contamination and consist essentially of:

(a) a circular ice container or, bin, for containing the dumped ice shapes; the ice container having an aperture in its bottom through which the ice shapes can fall if raked thereover;

(b) a rotary stirrer, or agitator, journalled near the center of the ice container for rotation and having at least one laterally extending arm for stirring the ice shapes and raking the ice shapes into the aperture;

(c) power means for rotating the stirrer upon demand;

(d) a cylindrical chute disposed below and connected with the aperture for receiving the ice shapes dropped through the aperture; the cylindrical chute having clean, smooth, unobstructed sides so as to facilitate cleaning and sterilizing after a corkscrew impeller has been removed;

(e) a cantilever corkscrew impeller removably journalled for rotation within the cylindrical chute for moving the ice shapes there along upon demand;

(f) corkscrew impeller rotation means for rotating the corkscrew impeller upon demand;

(g) quick disconnect fitting removably connecting a corkscrew impeller with the corkscrew impeller rotation means such that the corkscrew can be easily removed without tools for cleaning and sterilizing;

(h) means for signalling demand connected with the power means and the corkscrew impeller rotation means; and (i) spout means removably connected with the chute, the spout means being easily cleaned and sterilized.

Also disclosed are preferred embodiments in which the respective rotation means employ braking motors; in which a socket and key and slot combination are employed for allowing for easy removal of the corkscrew impeller, in which the spout means slips over the horizontal chute end and in which the spout means is connected with the door so as to be pulled off when the door is open.

BRIEF DESCRIPTION OF THE DRAWINGS

FIG. 1 is an isometric view of one embodiment of this invention.

FIG. 2 is a partial side elevational view, partly schematic, showing the bin and the chute of the embodiment of FIG. 1.

FIG. 3 is a side elevational view, partly in section, of the chute of the embodiment of FIG. 1.

FIG. 4 is a partial isometric view of the corkscrew impeller of the embodiment of FIG. 1.

DESCRIPTION OF THE PREFERRED EMBODIMENTS

With this invention, it is believed helpful to provide an overview and then to consider in greater detail the respective features. Referring to FIG. 1, the ice maker and dispenser 11 is shown with an exterior spout 13 through which the ice is ultimately dispensed. As can be seen in FIGS. 2 and 3, the ice maker and dispenser 11 has a container, or bin, 15 in which there is a stirrer, or agitator, 17 that is rotated to deliver the ice shapes 19 out of an aperture 21 in the bottom of the bin.

The ice falls into a chute 23 housing a conveyor, or corkscrew impeller, 25. The stirrer 17 is rotated by power means, such as the motor 29, by way of suitable drive interconnection 31 when ice is to be dispensed, or upon demand. Similarly, the corkscrew impeller is rotated by a braking motor 33 having a plug and socket 35 for receiving the corkscrew impeller 25. Corkscrew impeller 25 has a plug and socket 37 that can be plugged into or out of the socket 35 with about a one-fourth turn rotation. The impeller 25 is actually a spiral rod that is affixed, as by welding, to a base 39 on a plug in socket 37.

Examining the respective elements of the combination in more detail, the ice maker and dispenser 11 has therewithin an ice making unit 41 and an ice dumping means 43 for dumping the ice shapes that have been manufactured. The ice manufacturing unit 41 is capable of making and forming ice in shapes of less than two inches in dimension. The ice manufacturing unit 41 and ice dumping means 43 may comprise any of the conventional units that have been employed. As is recognized, the ice manufacturing unit employs a refrigerant, such as a Freon, which is compressed by a compresser to a high pressure, high temperture gas that is cooled in a condenser to a liquid. The liquid is then flashed through an evaporator in contact with water to make the ice. The refrigerant absorbs the heat from the water to convert the water into ice. In the process of absorbing the latent heat of fusion of the water the refrigerant is vaporized. The ice is then dumped. These units have included pipe-like units that stick into the water to freeze the ice shapes in the form of tubular cylinders, trays freezing cubes of ice, tray freezing sectors of a circle. The ice dumping means then may take any form; such as the use of hot refrigerant gas circulated in a by-pass arrangement through the same freezing unit to melt monomolecular layer of the ice next to the coil, separate rectangularly disposed heating wires that can be activated to heat the ice and cause to fall off as sheets that are cut in the form of rectangles or the like by the hot wires, the heating of the trays with removal fingers that run the sectors of a circle ice shapes out of their trays and into the ice bin. It is relatively immaterial to this invention which type of units is employed in the ice making unit and the ice dumping means 41, 43.

In any event, the ice shapes 19 are disposited in the bin, or container, 15. The container preferably has a sloping bottom 45 such that when the stirrer 17 is rotated, the arm tends to force the ice shapes 19 toward the aperture 21. As illustrated, the stirrer 17 has two arms that are diametrically opposed. This results in a better balanced unit than having a single arm that throws a moment force onto the shaft 47. The shaft 47 is journalled by a suitable means, such as bushings, bearings, or the like, illustrated by the bearing housing 49, for rotation. The arms are, ordinarily, formed of suitable material such as aluminum, stainless steel, brass, or the like; although plastic could be employed if it had adequate strength. The plastics such as Delrin, Orlon, Nylon or the like would have such strength. As is implied from the foregoing, the respective stirrer 17 is connected with the shaft 47 so as to rotate in use therewith. At its lower end, the shaft 47 is connected with a sprocket 51 that is driven by the drive unit 31. The drive unit may comprise a belt, or a sprocket type chain. The motor 29 has attached to its shaft a drive sprocket 53. It will be apparent, of course, that the drive means 31 may comprise belts and pulleys, suitable transmission gears, or the like. It has been found preferable to employ the indicated drive belt and sprockets. When the motor 29 is turned on, the drive 31 caused rotation of the stirrer 17 and stirs the ice shapes 19, raking them the aperture 21 until they fall into the chute 23.

The chute 23 is a cylindrical chute that is disposed below and connected with the apertures for receiving the ice shapes 19 that are dropped through the aperture 21. The cylindrical chute has clean, smooth, unobstructed sides to facilitate cleaning and sterilization after a corkscrew impeller is removed. A chute 55 interconnects horizontal chute 23 with the aperture 21 as illustrated in FIG. 3. As can be seen, the short vertical chute 55, is readily cleaned from the top through the ice bin 15. The horizontal chute is readily cleaned by a suitable brush with suitable sterilizing chemicals, hot water or the like after removal of the corkscrew impeller 25.

As can be seen in FIGS. 3 and 4, the corkscrew impeller comprises a corkscrew, or spiral, rod 57 that, when rotated, moves the ice shapes toward the spout 13 and dispense out of the chute 23. The spiral rod may comprise any suitable rod such as brass, aluminum, copper, or the like. Preferably as illustrated in the embodiment it comprises stainless steel such that it can be cleaned and sterilized without corrosion or the like. The spiral rod 57 is connected, as indicated hereinbefore, by welding or the like with the base 39. A supplemental support rod 59 is also affixed by welding to the base 39 and to the first turn of the spiral rod 57 for additional cantilever support. Of course, the respective elements can be affixed by bolts and nuts, allen screws or the like to the base 39. The base 39 has a sprocket 37 that can be affixed by merely inserting into the receiving sprocket 35 with a pin 61 engaging the key way slot 63. Thus when inserted, there is adequate longitudinal conforming engagements to support the spiral 25 in cantilever fashion from the base 39. If desired, the base 39 can be connected by way of bearings with a base plate to assist in the cantilever and free rotation action.

The rotation is affected by the motor 33. The motor 33 is a braking motor such that when the demand signal ceases, the motor brakes to a halt and stops the dispensing of ice cubes, or shapes, 19. While a key and key way quick disconnect fitting is shown, any other suitable fitting that will support the spiral corkscrew impeller 25 in cantilever fashion may be employed in this invention as long as it is capable also of imparting the torque to effect rotation of the corkscrew impeller.

At the outer end of the chute 23, there is a spout 13. In early models, the spout 13 was screwed onto the outermost end. Frequently this caused difficulties with the door being opened. Consequently, the spout was then slipped over the outermost end. Even this friction fit caused some difficulties. Accordingly, the spout 13 was then affixed to the door 71, FIG. 3 such that the spout slid from over the outer end of the chute 23 when the door was opened. This alleviated difficulties. As can be seen in FIG. 1, the spout 13 has a cover plate 73 at its bottom end to allow egress of the ice cubes against a mild spring bias, by moving to the position shown by the dotted line 75. The plate 73 will, however, move closed once the dispensing of the ice is finished and it is released, as by an orderly taking the container from the front of the plate 75. As can be seen in FIG. 1, the exterior recess 77 in the door has a sloping bottom drain plate 79 and a drain 81. Thus melting of excess ice, or ice inadvertently dropped into the pan 79 causes no difficulty. The drain 81 may be connected to a container that is emptied periodically or may be connected with the sewer drain for the particular building in which the machine is emplaced.

The chute 23 and the spout 13 are preferably formed of the same material so as to facilitate cleaning and sterilizing.

In operation, the ice making unit and ice dumping means 41, 43 are connected into the ice maker 11 with the condenser adjacent the grill work 83 and so as to dump the ice into the bin 15. The ice is periodically dumped as signalled. The stirrer 17 is then rotated by the motor 29 upon demand. The demand is supplied by any of the conventional modes. For example, a key 85 may comprise a switch into which an orderly or the like inserts the key and rotates the key to turn on the switch by supplying power from a suitable power source shown schematically in FIG. 2 by the contact 87. Power is then supplied by way of the key 85 to motor 29 and to motor 33 causing them to rotate as long as the key is maintained in the on position. When the orderly has enough ice, he releases the key to stop the motor. The motor 33 is a braking motor. If desired, the motor 29 can also be a braking motor to stop rotation of the stirrer 17. The interconnection of the key way and key 85 with the motors 29 and 33 is shown by the dashed line 91. Any other suitable means such as a switch mounted in the trap door, or plate 73, can be employed such that ice is dispensed as long as the plate is held open. This is subject to abuse, however; whereas, with the orderly key, only an orderly can effect dispensing of the ice.

As implied hereinbefore, the ice shapes 19 are moved over the aperture 21, falling through the chute 55 and into the chute 23. The rotation of the spiral 25 moves the ice outwardly and through the spout 13 into the container or the like being held below the spout by the orderly.

From the foregoing it can be seen that this invention achieves the objects delineated hereinbefore and alleviates the deficiences of the prior art. Specifically, it provides an ice maker and dispenser in which the dispensing chutes that are subject to contamination from microbiological sources can be readily cleaned and sterilized. The spiral corkscrew impeller can be removed by the simple expedient of a quarter turn without tools so that it can be cleaned and sterilized by any of the conventional means. When the door is open this opens up the horizontal chute 23 so it is readily cleaned and sterilized. The chute 55 can be cleaned and sterilized by brushed from below via the chute 23 but particularly from above by way of the ice bin 15.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

What is claimed is:

1. In an ice maker and dispenser having:

a. an ice manufacturing unit capable of making ice in shapes of less than two inches in dimensions; and b. an ice dumping means for dumping the ice shapes that have been manufactured and having a door for access thereto;

the improvement comprising an easily cleaned and sterilized model for use in areas subject to microbiological contamination, such as hospitals and the like, and consisting essentially of:

c. circular ice container for containing the dumped ice shapes; said ice container having an aperture at a first location in its bottom through which said ice shapes can fall if raked thereover;

d. a rotary stirrer journalled near the center of said ice container for rotation and having at least one laterally extending arm for stirring said ice shapes and raking said ice shapes into said aperture;

e. a power means for rotating said stirrer upon demand;

f. a cylindrical chute disposed below and connected with said aperture for receiving ice shapes dropped through said aperture; said cylindrical chute having clean, smooth, unobstructed sides to facilitate cleaning and sterilization after a corkscrew impeller is removed;

g. a cantilevered corkscrew impeller comprising a spiral stainless steel rod in the form of a corkscrew removably journalled for rotation within said cylindrical chute for moving said ice shapes therealong upon demand;

h. corkscrew impeller rotation means for rotating said corkscrew impeller upon demand;

i. quick disconnect fitting removably connecting said corkscrew impeller with said corkscrew impeller rotation means such that said corkscrew impeller can be easily removed without tools for cleaning and sterilizing; said quick disconnect fitting comprising a key and slot combination such that said corkscrew impeller can be removed with a quarter turn rotation to loosen said slot and thereafter be pulled from said chute; said spiral stainless steel rod in the form of a corkscrew being affixed to a base that is connected to said key and slot combination and having a supplemental structural member extending from said base to said corkscrew for additional cantilever support;

j. means for signalling demand connected with said power means and said corkscrew impeller rotation means; and k. spout means removably connected with the exterior end of said chute; said spout means being easily cleaned and sterilized after removal from said chute;

said spout means being connected with said door and located so as to be slipped over the outer end of said chute when said door is closed and to be removed from the outer end of said chute when said door is opened; said spout being easily cleaned and sterilized from the backside of said door and having a trap door that is normally biased closed at its outermost and free end through which the ice will be dispensed but minimizing invasion of any contaminating fluids or microorganisms in the air.

* * * * *